US006267101B1

(12) United States Patent
Kim

(10) Patent No.: US 6,267,101 B1
(45) Date of Patent: Jul. 31, 2001

(54) DEVICE FOR PREVENTING UNBALANCE BETWEEN RESPECTIVE ENGINE CYLINDERS OF A MOTOR VEHICLE

(75) Inventor: Young-Gab Kim, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/469,314

(22) Filed: Dec. 22, 1999

(30) Foreign Application Priority Data

Jun. 11, 1999 (KR) ..... 99-21697

(51) Int. Cl.[7] ..... F02D 41/08
(52) U.S. Cl. ..... 123/436; 701/110
(58) Field of Search ..... 123/436, 492, 123/352–355, 357; 701/110

(56) References Cited

U.S. PATENT DOCUMENTS 4,883,038 * 11/1989 Nakaniwa ..... 123/436
5,279,271 * 1/1994 Hofsaess et al. ..... 701/110 X
5,495,841 * 3/1996 Gillbrand et al. ..... 123/492
5,526,794 * 6/1996 Messih et al. ..... 123/492
5,568,799 * 10/1996 Akazaki et al. ..... 123/492 X

* cited by examiner

*Primary Examiner*—Tony M. Argenbright

(57) ABSTRACT

A device for preventing unbalance between respective engine cylinders of a motor vehicle adapted to adjustingly control the fuel amount supplied to each cylinder of the engine, and the injection time, according to engine revolution changes to thereby reduce engine noise caused by deviation of engine revolutions. The device includes: a unit for detecting engine speed and fuel amount relative to each cylinder when fuel is supplied to each cylinder of the engine; a unit for respectively adjusting injection pulse width responsive to the engine speed and fuel amount detected by the detecting unit; and a unit for establishing a driving time of injection to each cylinder for the engine speed to be close to a reference speed for the injection pulse widths of the respective cylinders.

3 Claims, 4 Drawing Sheets

DEVICE FOR PREVENTING UNBALANCE BETWEEN RESPECTIVE ENGINE CYLINDERS OF A MOTOR VEHICLE

BACKGROUND OF THE INVENTION

1. Field of the Invention

The present invention relates to a device for preventing unbalance of between respective engine cylinders of a motor of vehicle, and more particularly to a device for preventing of unbalanced engine cylinder of a vehicle by adjusting injection time of fuel, and fuel supply to each cylinder, of a disel engine according to variations of engine revolutions, thereby preventing engine noise caused by deviation of engine revolutions.

2. Description of the Prior Art

Generally, a diesel engine serves to change a fuel injection time to increase or decrease the supplied amount of fuel, thereby adjusting the load. The size of the load is adjusted by the change of injection time to thereby influence the progress of a heat production rate, whereby, the progress of the heat production rate largely dominates a cylinder pressure rise rate which is one of the greatest causes of generating vibration and noise.

Furthermore, fuel injection quantity control of diesel engines is calculated from an operation signal as a basic injection amount, where the signal is produced by operating signals detected and input by a crank angle position sensor and engine revolution sensor, and the basic injection amount is accurately corrected by signals input from other sensors to allow fuel to be injected from an injector.

However, there is a problem in that actual idle engine revolutions can be excessively increased during fuel supply to the engine according to the fuel injection amount thus determined to thereby produce a deviation substantially larger than prior set-up reference revolutions, and even if the same fuel injection amount is supplied to each cylinder, large errors are inevitably produced.

The reason is that the engine idle revolutions differ greatly from the actual revolutions as time lapses due to various factors such as engine deterioration, decreased processing quality of injectors, varied engine characteristic capacity differences per cylinder, and the like, and the difference of engine revolutions shows up as noise during engine idling, thereby resulting in installation of noise reducers such as noise suction and cut-off materials in order to remove the noise.

SUMMARY OF THE INVENTION

The present invention is provided to solve the aforementioned problems and it is an object of the present invention to provide a device for preventing unbalance between respective engine cylinders of a motor vehicle adapted to supply different overall fuel amounts to a diesel engine, per engine cylinder, according to changes of engine revolutions to thereby control actual engine idle revolutions to approach a reference revolutions, whereby, deviation of revolution for each engine cylinder can be reduced to prevent unbalance of each cylinder, thereby decreasing engine noise during idle revolutions of the engine.

In accordance with the object of the present invention, there is provided a device for preventing unbalance of engine cylinders of vehicle, the device comprising:

means for detecting engine speed and fuel amount relative to each cylinder when fuel is supplied to each cylinder of the engine;

means for respectively operating a start of an injection pulse and an end thereof responsive to engine speed and fuel amount detected by the detecting means; and means for establishing a driving time of injection to each cylinder to enable the engine speed to be close to a reference speed with the injection pulse start and injection pulse end operated by the above operating means.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

A preferred embodiment of the present invention will now be described in detail with reference to the accompanying drawings.

Figure 1:
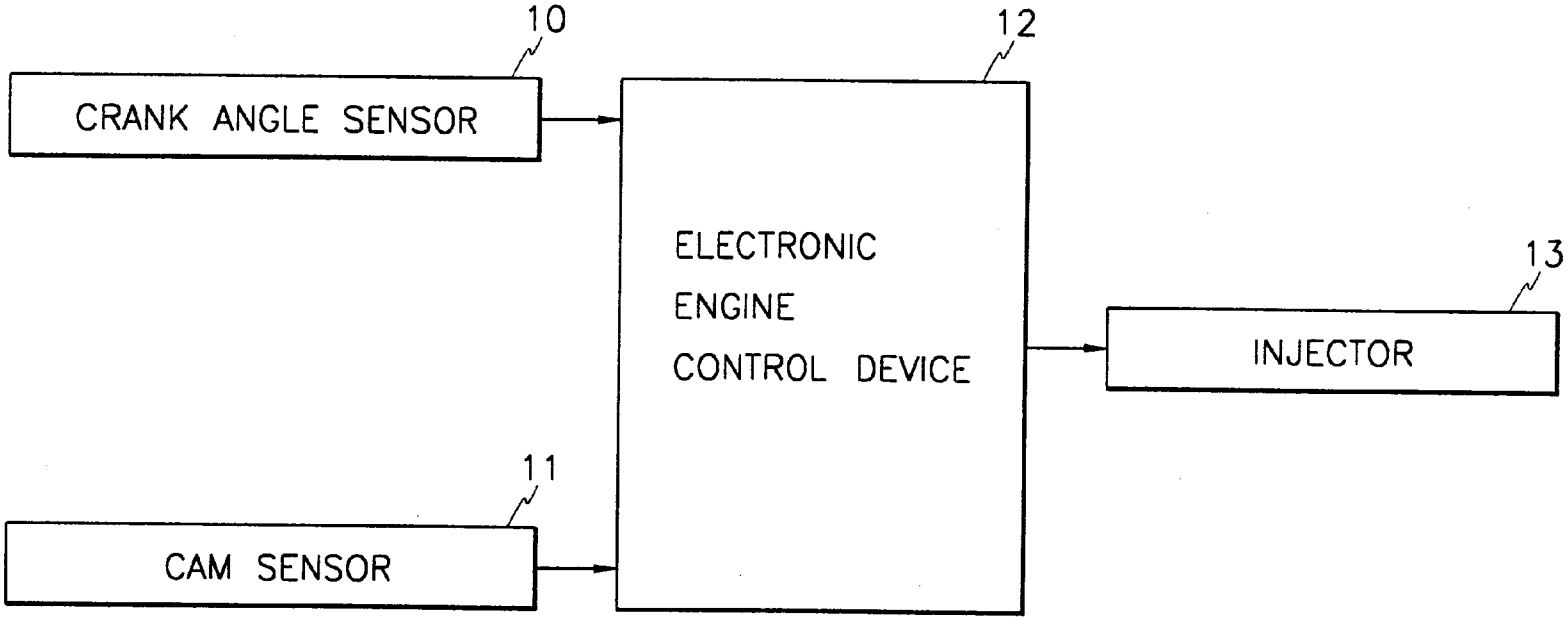
FIG. 1 is a schematic block diagram for illustrating an electronic engine control device according to the present invention.
Figure 2:
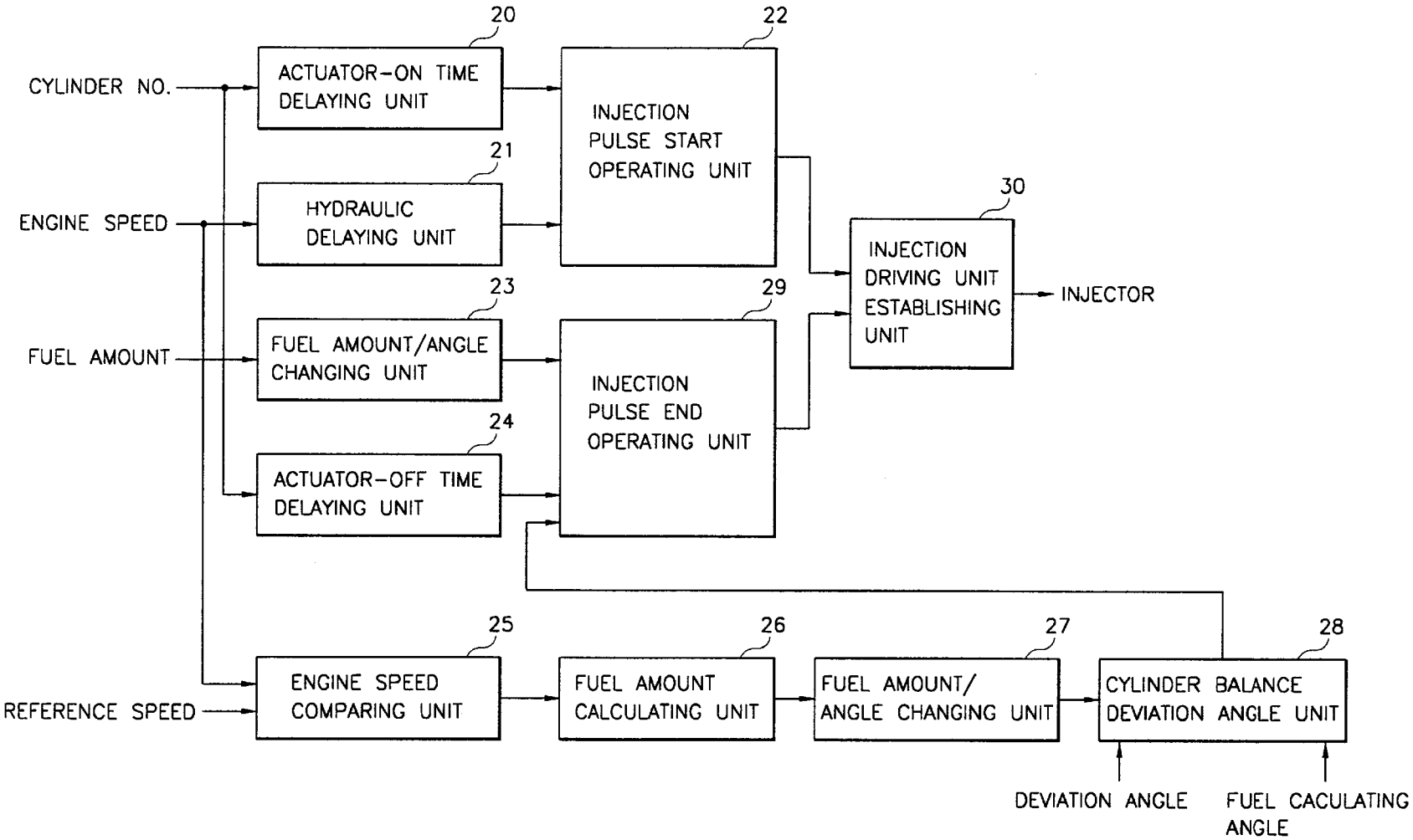
FIG. 2 is a control block diagram for illustrating an engine cylinder unbalance prevention device according to the present invention.

FIG. 1 is a schematic block diagram for illustrating an electronic engine control device according to the present invention; and FIG. 2 is a control block diagram for illustrating an engine cylinder unbalance prevention device according to the present invention. The engine cylinder unbalance prevention device includes a crank angle sensor 10 for detecting engine revolutions, a cam sensor 11 for detecting ignition timing of a cylinder, an electronic engine control device 12 for controlling signals detected by the crank angle sensor 10 and the cam sensor 11 responsive to a predetermined program to thereby output the controlled signal, and an injector 13 for injecting fuel according to the control signal output from the electronic engine control device 12.

The electronic engine control device 12 includes an actuator-ON time delaying unit for delaying a turn-on timing of an actuator of each cylinder, a hydraulic delaying unit 21 for detecting engine speed input from the crank angle sensor 10 to thereby delay a cylinder valve open/close timing, an injection pulse start operating unit 22 for operating an injection pulse start timing by way of the delayed timing output from the actuator-on time delaying unit 20 and the hydraulic delaying unit 21, a fuel amount/angle changing unit 23 for changing injected fuel amount to an angle signal, an actuator-OFF time delaying unit 24 for delaying a turn-off timing of an actuator of each cylinder, an engine speed comparing unit 25 for comparing the input engine speed with reference engine speed, a fuel amount calculating unit 26 for calculating fuel amount by way of the difference of the engine speed compared by engine speed comparing unit 25, a fuel amount/angle changing unit 27 for changing the fuel amount calculated by the fuel amount calculating unit 26 to an engine signal, a cylinder balance deviation angle unit 28 for outputting a cylinder balance deviation angle according to the angle changed by the fuel amount/angle changing unit 27, an injection pulse end operating unit 29 for operating respective signals of the fuel amount/angle changing unit 23, the actuator-OFF signal output from the actuator-OFF time delaying unit 24 and cylinder balance deviation angle output from the cylinder balance deviation angle unit 28 to thereby operate an injection pulse end, and an injection driving time establishing unit 30 for establishing the injection driving time according to the injection pulse start output from the injection pulse start operating unit 22 and the injection pulse end output from the injection pulse end operating unit 29.

Figure 3:
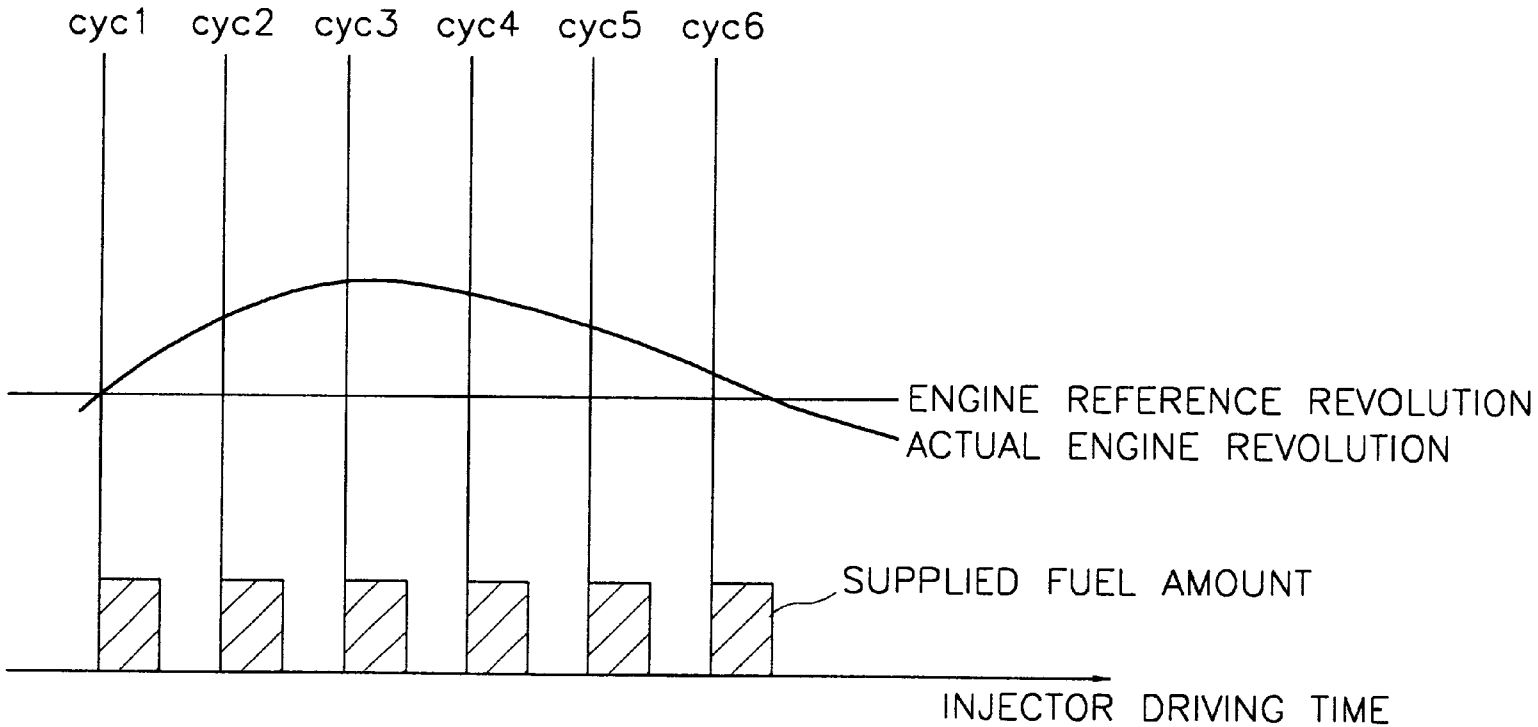
FIG. 3 is a timing diagram for illustrating an injector driving time relative to engine cylinder revolutions according to the present invention.

When an engine is started, an engine revolution and engine ignition timing relative to each cylinder are detected by the crank angle sensor 10 and the cam sensor 11, as illustrated in FIG. 3, and the detected signal is input to the electronic engine control device 12 to control the injector 13 according to a predetermined program established at the electronic engine control device 12, such that fuel is supplied to each cylinder of the engine.

At this time, the electronic engine control device 12 operation of detects each cylinder of the engine by way of the cam sensor 11 to delay ON-timing of the actuator at the actuator-ON timing delaying unit 20, and at the same time, detects the engine speed by way of the crank angle sensor 10 to input the same to the hydraulic delaying unit 21, thereby delaying a valve open/close operating time of a cylinder.

The delayed valve open/close operating signal of the cylinder delayed by the actuator-ON timing delaying unit 20 and the hydraulic delaying unit 21 is supplied to the injection pulse start operating unit 22, whereby, an injection pulse start timing is operated relative to an input cylinder number, and the operated injection pulse start timing is output for input into the injection pulse driving time establishing unit 30.

Furthermore, the electronic engine control device 12 converts to angle signals through the fuel amount/angle changing unit 23 with regard to prior an established fuel amount (basic fuel amount) to output the same to the injection pulse end operating unit 29. Signals of respective cylinders detected by the cam sensor 11 are input to the actuator-OFF time delaying unit 24 to delayedly output the OFF driving time of the actuator and again output to the injection pulse end operating unit 29.

The engine speed detected by the crank angle sensor 10 is compared with a randomly set-up reference speed at the engine speed comparing unit 25 to thereby output a speed difference signal, which in turn calculates a fuel amount according to the fuel amount calculating unit 26. The calculated fuel amounts are converted to angle signals via the fuel amount/angle changing unit 27 to be input to the cylinder balance deviation angle unit 28, where, a deviation angle is calculated by the cylinder balance deviation angle unit 28 to thereafter be output to the injection pulse end operating unit 29.

Successively, the injection pulse end operating unit 29 operates on the angle signal output from the fuel amount/angle changing unit 23, the delayed actuator-OFF time output from the actuator-OFF time delaying unit 24 and the deviation angle obtained from the cylinder balance deviation angle unit 28, and outputs an injection pulse end signal to input the same to the injection driving time establishing unit 30.

Figure 4:
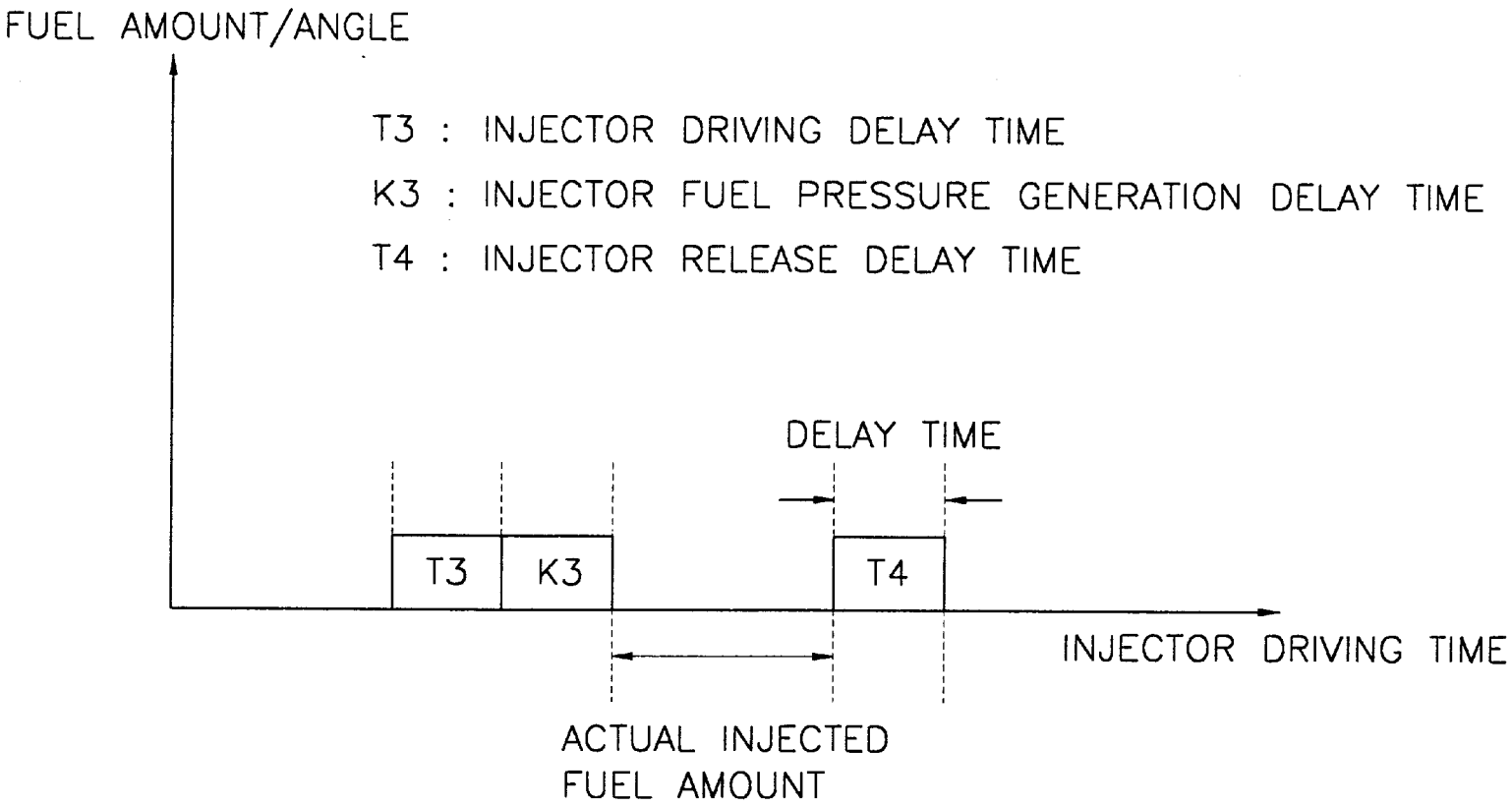
FIG. 4 is an injector driving timing diagram of a engine cylinder unbalance prevention device according to the present invention.

Accordingly, the injection driving time establishing unit 30 controls the input injection pulse start and end signals to establish an injection driving time. The established injection driving time drives the injector 13 as illustrated in FIG. 4, thereby establishing a fuel injection driving time of injector 13. Fuel is then injected to respective cylinders according to the established driving time as illustrated in FIG. 3.

As apparent from the foregoing, there is an advantage in the device for preventing unbalance of engine cylinders of vehicle thus described according to the present invention, in that engine cylinders and engine speed (engine revolution) are detected when fuel is injected in a diesel engine with an injector, whereby, fuel injection times (fuel amount) for each cylinder at the engine are differently distributed and injected according to the deviation between the reference revolution and the detected cylinders and engine speed, thereby approximately controlling the actual engine idle revolution to the reference revolution, such that engine noise generated by deviation of revolutions at each cylinder during the idle revolution of the engine can be easily reduced.

What is claimed is:

1. A device for preventing unbalance of engine cylinders of a vehicle, the device comprising:

means for detecting engine speed and fuel amount relative to each cylinder when fuel is supplied to each cylinder of the engine;

means for respectively operating an injection pulse start and injection pulse end by way of the engine speed and fuel amount detected by the above detecting means; and means for establishing a driving time of injection to each cylinder for the engine speed to be close to a predetermined reference speed with the injection pulse start and injection pulse end operated by the above operating means.

2. The device as defined in claim 1, wherein the injection pulse start operating means detects for each cylinder of the engine an engine speed, when fuel is injected to the engine, to initiate the start of an injection pulse for the detected cylinder, and engine speed as a randomly established and determined delay time.

3. The device as defined in claim 1, wherein the injection pulse end operating means comprises:

means for converting a predetermined fuel amount to an angle signal related to a crank angle of the engine;

means for delaying an actuator-OFF time for each cylinder of the engine;

means for comparing the engine speed with a reference speed to calculate a difference of speed therebetween;

means for calculating the fuel amount according to the calculated difference of speed;

means for converting the calculated fuel amount to an angle signal; and means for obtaining a cylinder balance deviation angle according to the converted angle signal.

* * * * *